US011325138B2

(12) United States Patent
Kuo

(10) Patent No.: US 11,325,138 B2
(45) Date of Patent: May 10, 2022

(54) NOZZLE FOR PROVIDING A HELICAL SPRAY

(71) Applicant: ZHANGZHOU LEYUAN INDUSTRIAL CO., LTD., Zhangzhou (CN)

(72) Inventor: Wen-Li Kuo, Zhangzhou (CN)

(73) Assignee: ZHANGZHOU LEYUAN INDUSTRIAL CO., LTD., Zhangzhou (CN)

( * ) Notice: Subject to any disclaimer, the term of this patent is extended or adjusted under 35 U.S.C. 154(b) by 72 days.

(21) Appl. No.: 17/016,725

(22) Filed: Sep. 10, 2020

(65) Prior Publication Data

US 2022/0072567 A1 Mar. 10, 2022

(51) Int. Cl.

| | |
|---|---|
| ***B05B 1/02*** | (2006.01) |
| ***B05B 1/26*** | (2006.01) |
| ***B05B 1/14*** | (2006.01) |
| ***B05B 1/34*** | (2006.01) |

(52) U.S. Cl.

CPC ..... *B05B 1/02* (2013.01); *B05B 1/14* (2013.01); *B05B 1/262* (2013.01); *B05B 1/3405* (2013.01); *B05B 1/3415* (2013.01); *B05B 1/3421* (2013.01); *B05B 1/3426* (2013.01)

(58) Field of Classification Search

CPC .. B05B 1/02; B05B 1/14; B05B 1/262; B05B 1/3405; B05B 1/3415; B05B 1/3421; B05B 1/3426

USPC ..... 239/390, 396, 461, 463, 468, 469, 483, 239/490, 553, 553.5, 556, 590, 590.5

See application file for complete search history.

(56) References Cited

U.S. PATENT DOCUMENTS

| | | | | |
|---|---|---|---|---|
| 2,651,547 | A * | 9/1953 | Calhoun | B05B 1/14 239/490 |
| 6,412,710 | B1 * | 7/2002 | Lin | B05B 1/1645 239/461 |
| 8,104,697 | B2 * | 1/2012 | Petrovic | B05B 1/04 239/463 |
| 8,640,980 | B2 * | 2/2014 | Nordstrom | B05B 1/185 239/553 |
| 9,630,191 | B2 | 4/2017 | Kuo | |
| 2003/0042331 | A1 * | 3/2003 | Lu | B05B 1/1654 239/556 |

* cited by examiner

*Primary Examiner* — Steven J Ganey

(74) *Attorney, Agent, or Firm* — Karin L. Williams; Alan D. Kamrath; Mayer & Williams PC

(57) ABSTRACT

A nozzle includes a shell, a distributor, a panel and a collar. The distributor is inserted in the shell. The distributor includes protuberances each of which includes a cylindrical section, a conical section extending from the cylindrical section, and two fins extending from the cylindrical section. The panel includes outlets and tubes. The outlets extend through the panel. Each of the tubes is in communication with a corresponding one of the outlets and includes tangential passageways. Each of the tubes receives a corresponding one of the protuberances. The tangential passageways of each of the tubes receive the fins of the corresponding protuberance so that each of the tangential passageways is partially blocked by the corresponding fin. The collar is connected to the shell and includes an annular flange. The collar receives the panel. The panel is sandwiched between the annular flange of the collar and an end of the shell.

9 Claims, 10 Drawing Sheets

NOZZLE FOR PROVIDING A HELICAL SPRAY

BACKGROUND OF INVENTION

1. Field of Invention

The present invention relates to a nozzle and, more particularly, to a nozzle for providing a helical spray.

2. Related Prior Art

Sprayers are often used in gardening. Various sprayers have been devised to provide different patterns of sprays. For example, U.S. Pat. No. 9,630,191 issued to the present applicant discloses a conventional sprayer that includes a surface cover 1, a water distribution member 2 and a body 3. The surface cover 1 is formed with multiple orifices 11. The internal side of the surface cover 1 is formed with multiple annular flanges 12 corresponding to the orifices 11. Each flange 12 is formed with two tangential openings 13 tangent to an internal wall 14 of the flange 12. In use, water goes into the body 3 via an inlet. Then, the water goes into the surface cover 1 from the body 3 via multiple holes 21 of the water distribution member 2. Then, a portion of the water enters each flange 12 via the two tangential openings 13 in two streams to form a whirlpool. Finally, the water is sprayed from the orifices 11.

However, several problems have been encountered in the operation of the conventional sprayer. Firstly, the streams interfere with each other in each flange 12 so that a water swirl in each flange 12 is reduced. Hence, the range of the spray from the orifices 11 is small.

Secondly, the surface cover 1 is often merged with the water distribution member 2 via ultrasonic waves. Hence, they cannot be taken from each other to remove undesired substances once such undesired substances enter them. The tangential openings 13, space in the flanges 12 or the orifices 11 could be jammed and the effect of the spraying could be reduced.

Thirdly, the orifices 11 of the surface cover 1 must be aligned with the holes 21 of the water distribution member 2 before the surface cover 1 is connected to the water distribution member 2. This is a troublesome practice.

The present invention is therefore intended to obviate or at least alleviate the problems encountered in the prior art.

SUMMARY OF INVENTION

It is the primary objective of the present invention to provide a nozzle for effectively providing a helical spray.

To achieve the foregoing objective, the nozzle includes a shell, a distributor, a panel and a collar. The distributor is inserted in the shell. The distributor includes protuberances each of which includes a cylindrical section, a conical section extending from the cylindrical section, and two fins extending from the cylindrical section. The panel includes outlets and tubes. The outlets extend through the panel. Each of the tubes is in communication with a corresponding one of the outlets and includes tangential passageways. Each of the tubes receives a corresponding one of the protuberances. The tangential passageways of each of the tubes receive the fins of the corresponding protuberance so that each of the tangential passageways is partially blocked by the corresponding fin. The collar is connected to the shell and includes an annular flange. The collar receives the panel.

The panel is sandwiched between the annular flange of the collar and an end of the shell.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
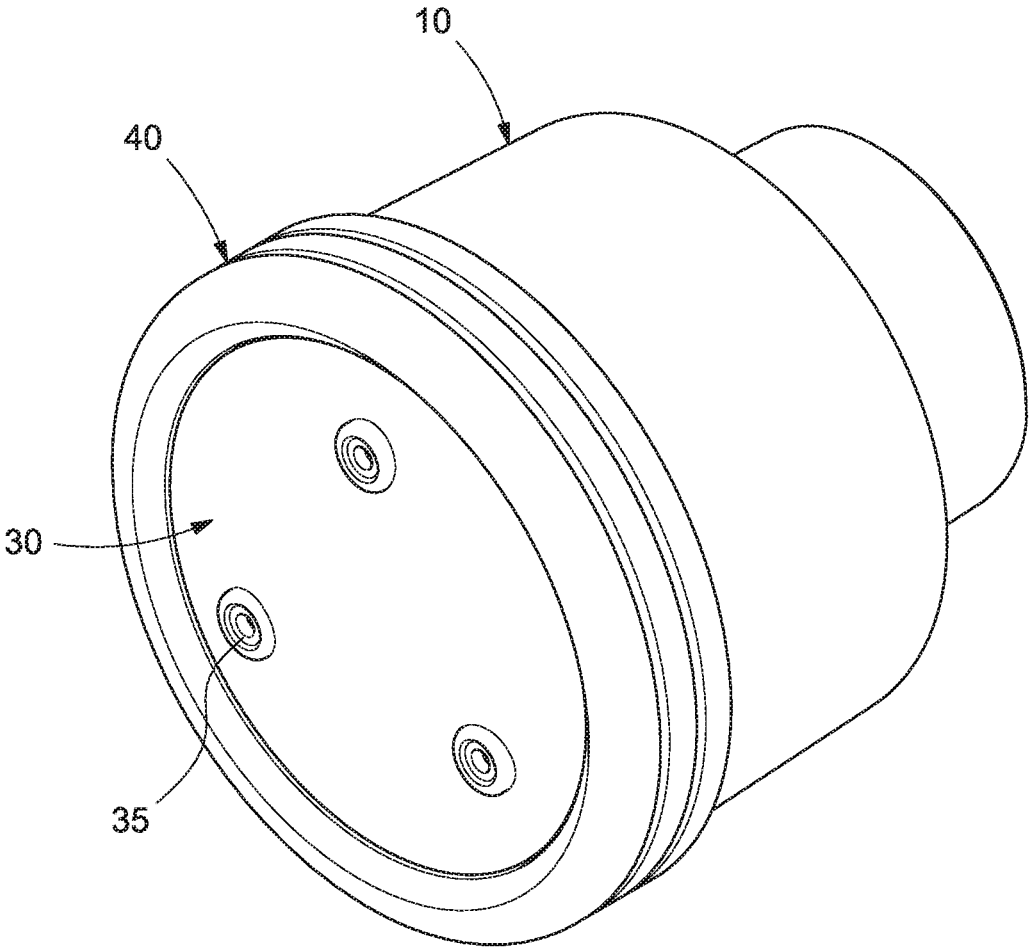
FIG. 1 is a perspective view of a nozzle for providing a helical spray according to the preferred embodiment of the present invention.
Figure 2:
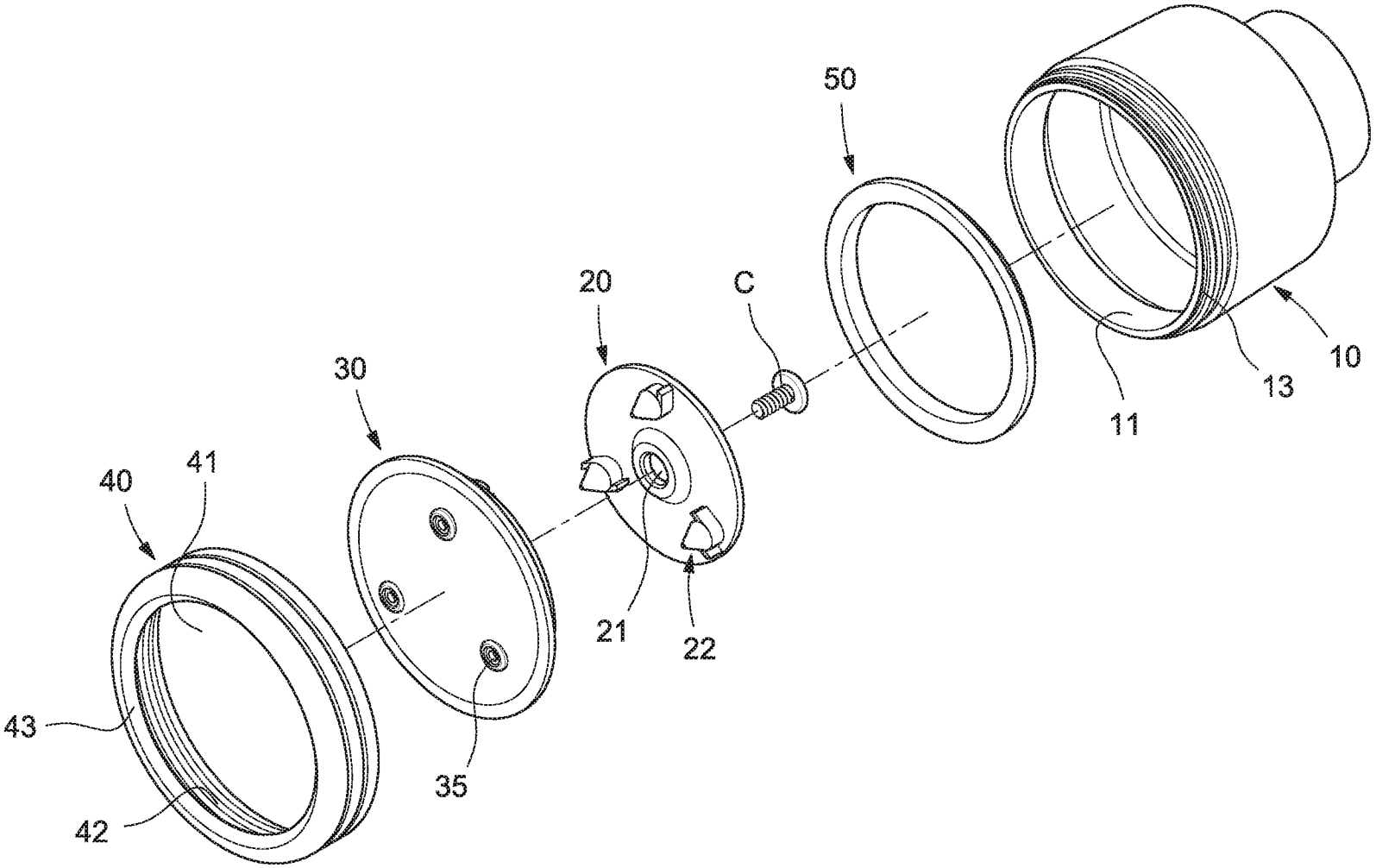
FIG. 2 is an exploded view of the nozzle shown in FIG. 1.
Figure 3:
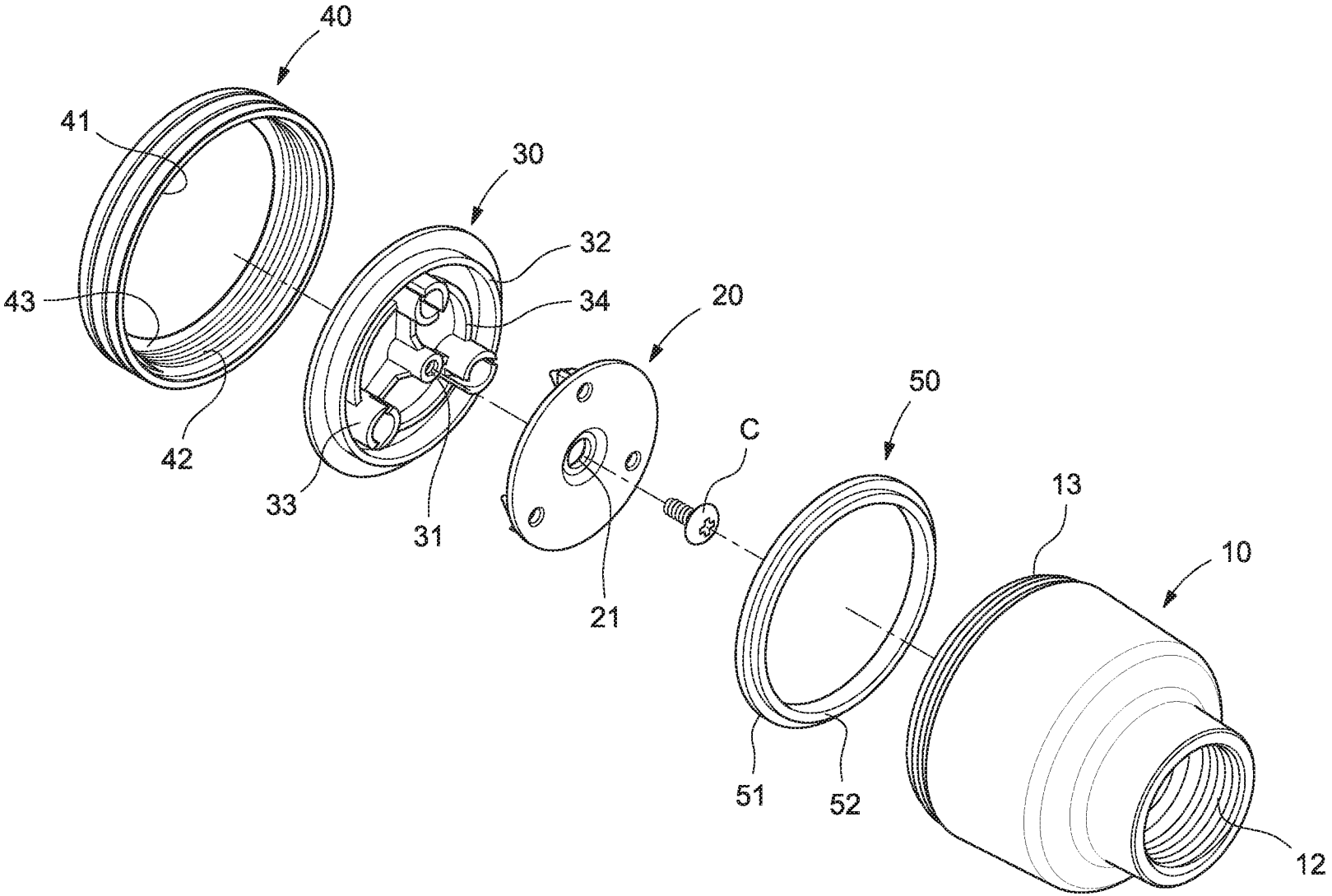
FIG. 3 is another exploded view of the nozzle shown in FIG. 1.
Figure 4:
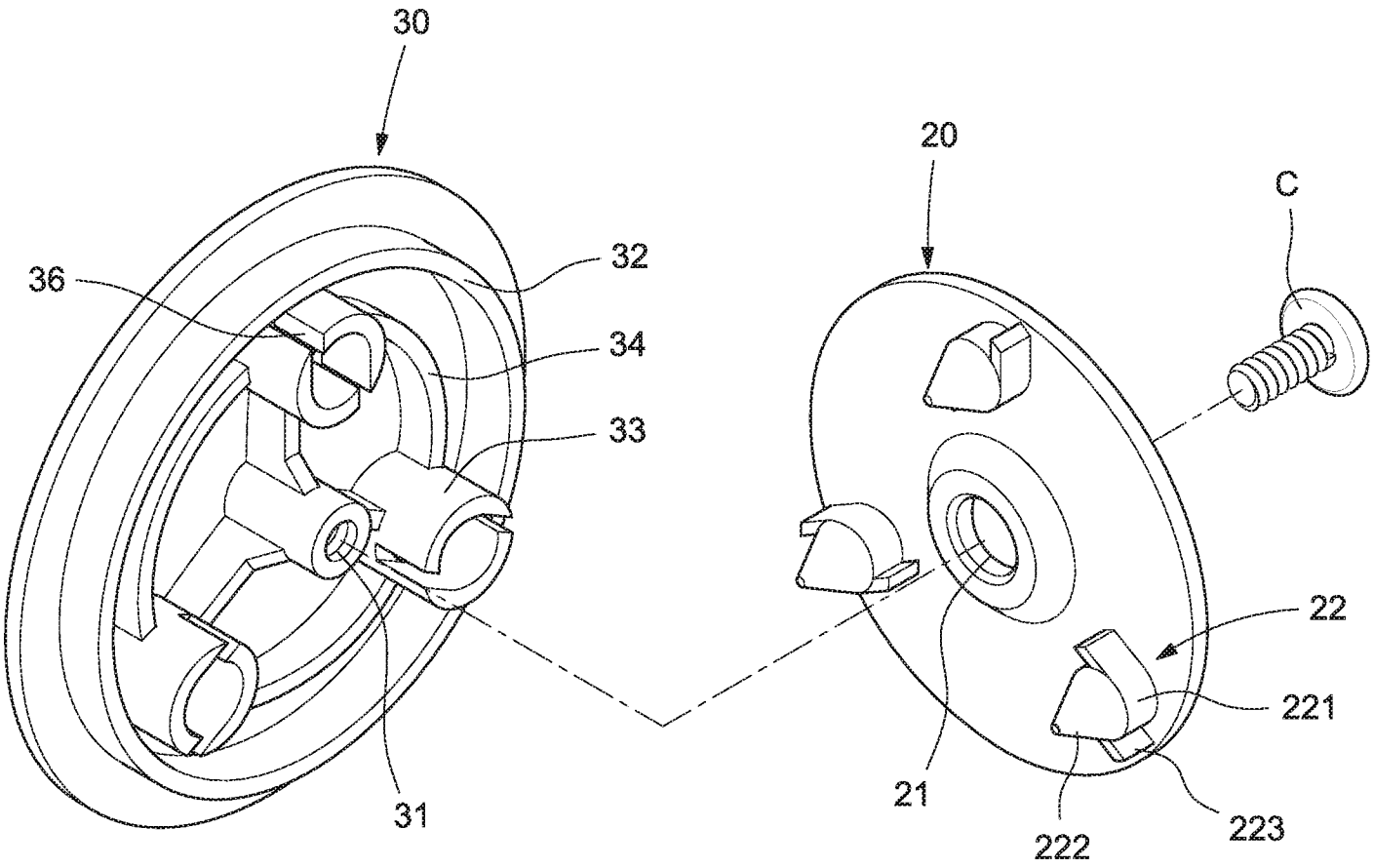
FIG. 4 is a partial and exploded view of the nozzle shown in FIG. 1.
Figure 5:
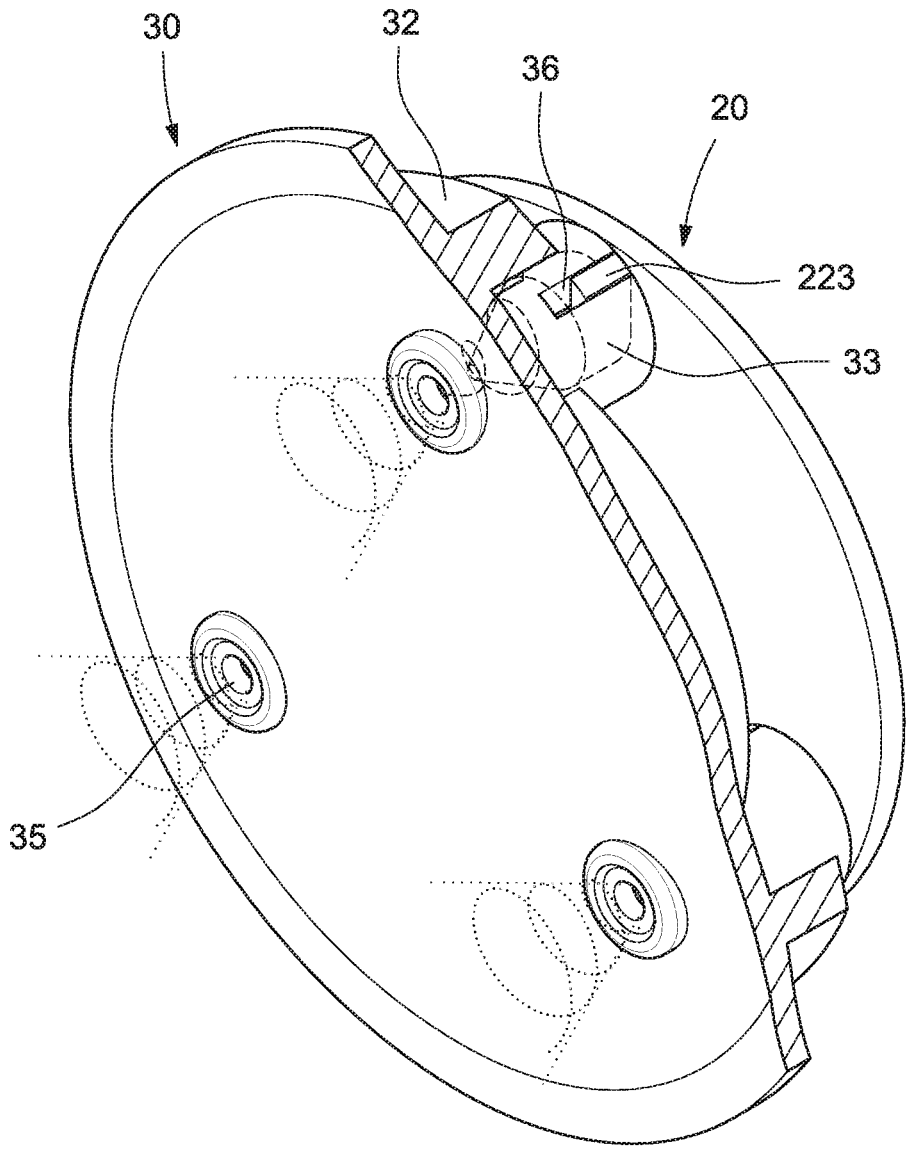
FIG. 5 is a cut view-away view of the nozzle shown in FIG. 4.
Figure 6:
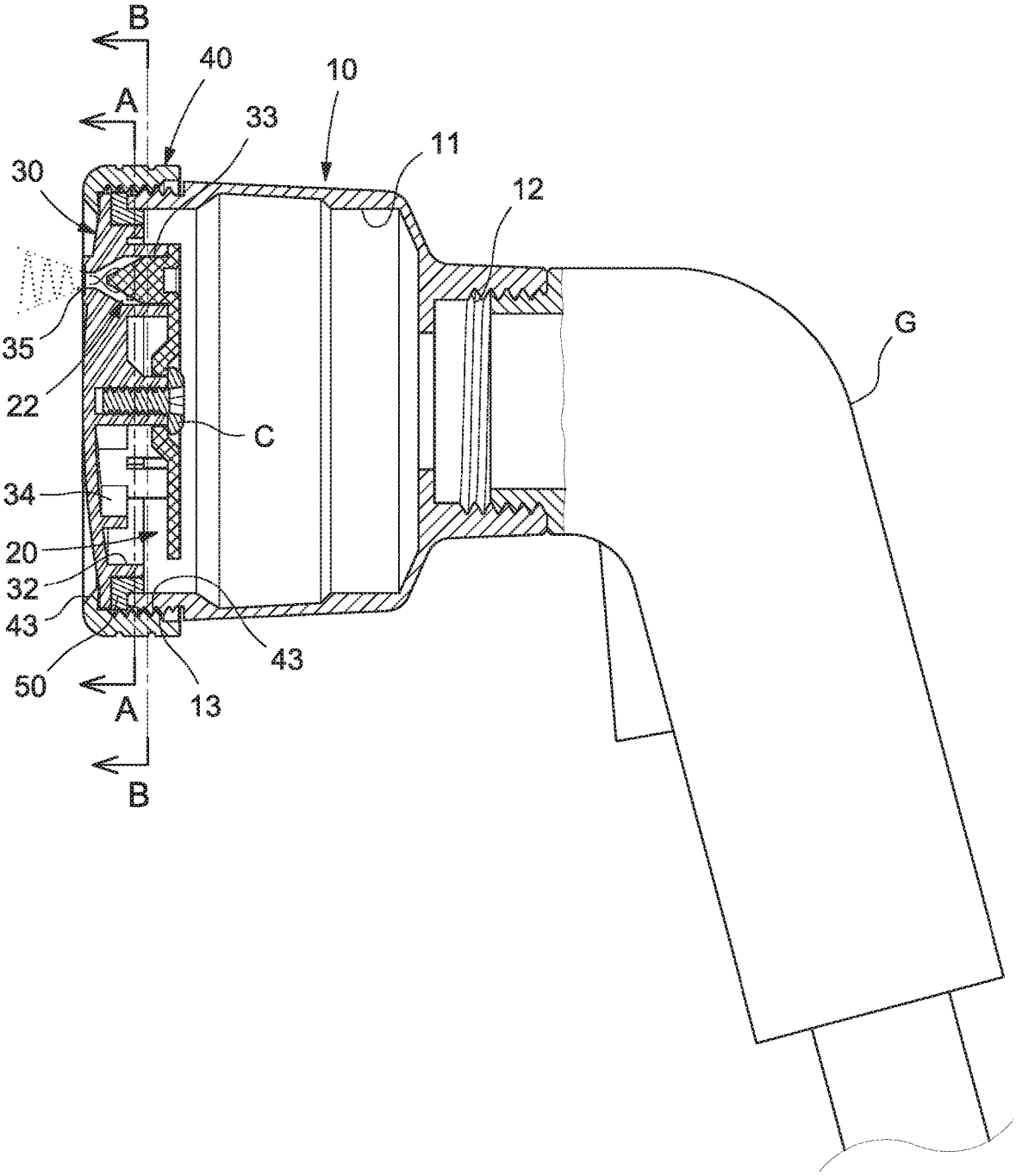
FIG. 6 is a cross-sectional view of a barrel of a sprayer connected to the nozzle shown in FIG. 1.

Referring to FIGS. 1 through 7, a nozzle for providing a helical spray includes a shell 10, a distributor 20, a panel 30, a collar 40 and a sealing ring 50 according to the preferred embodiment of the present invention. The shell 10 includes a chamber 11, an internal thread 12 and an external thread 13. The chamber 11 axially extends through the shell 10. The internal thread 12 extends on an internal face of the shell 10 at a rear end of the shell 10. The external thread 13 extends on an external face of the shell 10 at a front end of the shell 10. The internal thread 12 is used for engagement with a hose W or a barrel of a sprayer G.

The distributor 20 includes an orifice 21 and multiple protuberances 22. The orifice 21 axially extends through the distributor 20. The protuberances 22 are formed on a front face of the distributor 20. Each of the protuberances 22 includes a cylindrical section 221 extending from the front side of the distributor 20 and a conical section 222 extending from the cylindrical section 221. Two fins 223 extend from two opposite sides of the cylindrical section 221 of each of the protuberances 22.

The panel 30 includes a screw hole 31, an external annular portion 32, multiple tubes 33, an internal annular portion 34, multiple outlets 35 and multiple tangential passageways 36. The screw hole 31 is made in a rear face of the panel 30 corresponding to the orifice 21 of the distributor 20.

The external and internal annular portions 32 and 34 coaxially extend from the rear face of the panel 30, around the screw hole 31. The external annular portion 32 is made with diameter smaller than that of the panel 31. The internal annular portion 34 is formed with an axial length than that of the external annular portion 32.

The tubes 33 extends from the rear face of the panel 30. The tubes 33 are formed with a length larger than that of the external annular portion 32. The tubes 33 are evenly located along the internal annular portion 34, corresponding to the protuberances 22. Each of the tubes 33 includes an internal face in compliance with the cylindrical section 221 of each of the protuberances 22.

The outlets 35 extend through the panel 30. Each of the outlets 35 is in communication with interior of a corresponding one of the tubes 33.

Two of the tangential passageways 36 are made in a corresponding one of the tubes 33, corresponding to the fins 233 that extend from one of the protuberances 22. The fins 233 that extend from each of the protuberances 22 extend in and hence partially block the tangential passageways 36 that are made in a corresponding one of the tubes 33. Each of the tangential passageways 36 extends in a tangential direction of an internal face of each of the corresponding tubes 33.

The collar 40 includes an opening 41, a thread 42 and an annular flange 43. The opening 41 axially extends through the collar 40 to receive the panel 30. The thread 42 extends on an internal face of the collar 40, corresponding to the external thread 13 of the shell 10. The annular flange 43 extends from the internal face of the collar 40 to reduce a diameter of a portion of the opening 41, i.e., providing a reduced end of the opening 41. The annular flange 43 is used to abut against the panel 30 so that the panel 30 cannot be moved from the collar 40 through the reduced end of the opening 41.

The sealing ring 50 is located between the shell 10 and the panel 30. The sealing ring 50 is L-shaped in a cross-sectional view. That is, the sealing ring 50 includes a transverse section 51 and a longitudinal section 52. The transverse section 51 is located between the front end of the shell 10 and the rear face of the panel 30. The longitudinal section 52 is located between the internal face of the shell 10 and an external face of the external annular portion 32.

Referring to FIGS. 1 through 10, the panel 30 is inserted in the opening 41. The panel 30 in contact with the annular flange 43 of the collar 40. The distributor 20 is connected to the panel 30 by a screw C that is inserted in the screw hole 31 via the orifice 21. Each of the protuberances 22 of the distributor 20 is inserted in a corresponding one of the tubes 33 of the panel 30. The transverse portion 51 of the sealing ring 50 is located between the rear face of the panel 30 and the front end of the shell 10. The longitudinal portion 52 of the sealing ring 50 is located between the external face of the external annular portion 32 of the panel 30 and the internal face of the shell 10. The external thread 13 of the shell 10 is engaged with the thread 41 of the collar 40 so that the elements are locked to one another.

Figure 7:
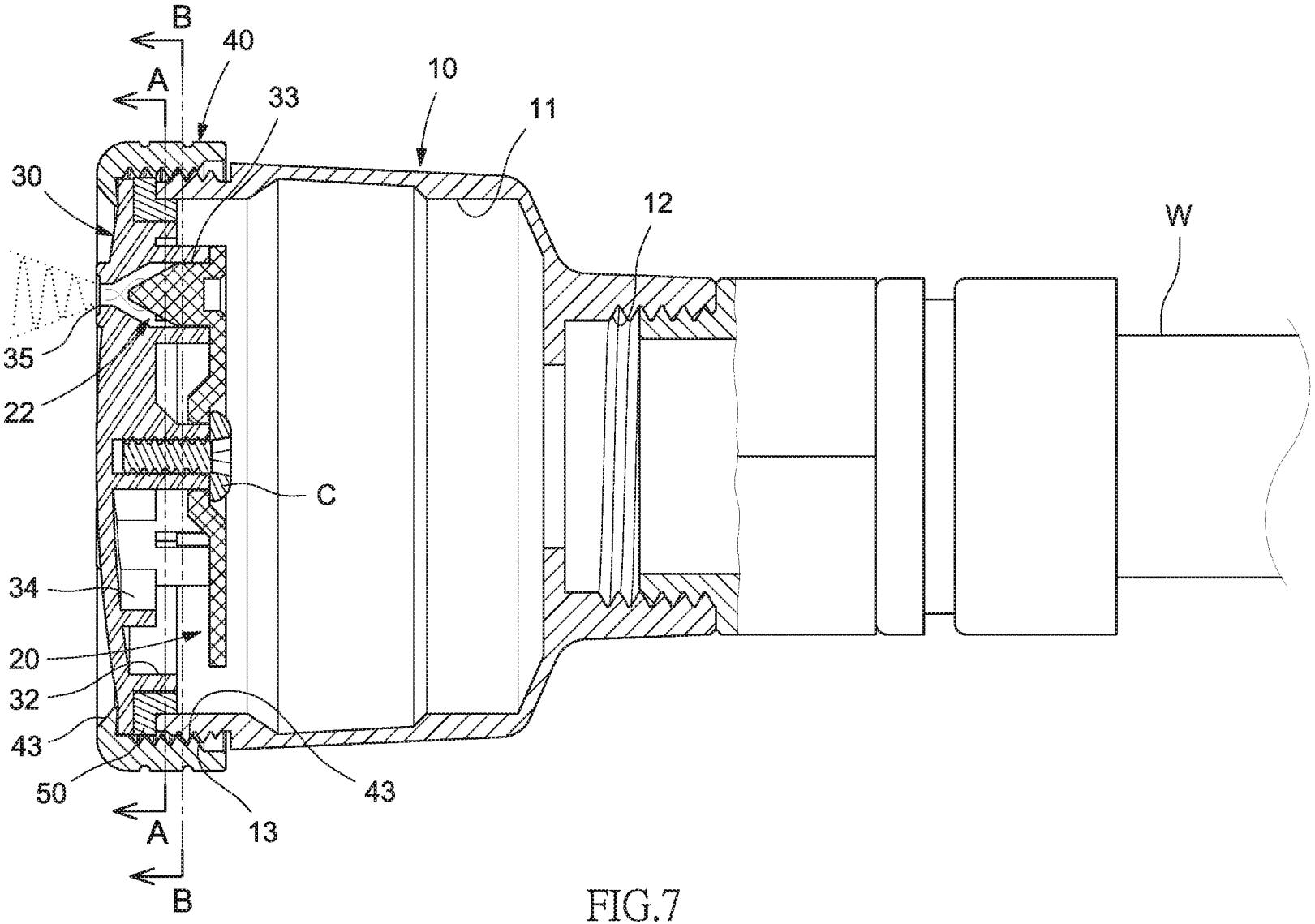
FIG. 7 is a cross-sectional view of a hose connected to the nozzle shown in FIG. 1.
Figure 8:
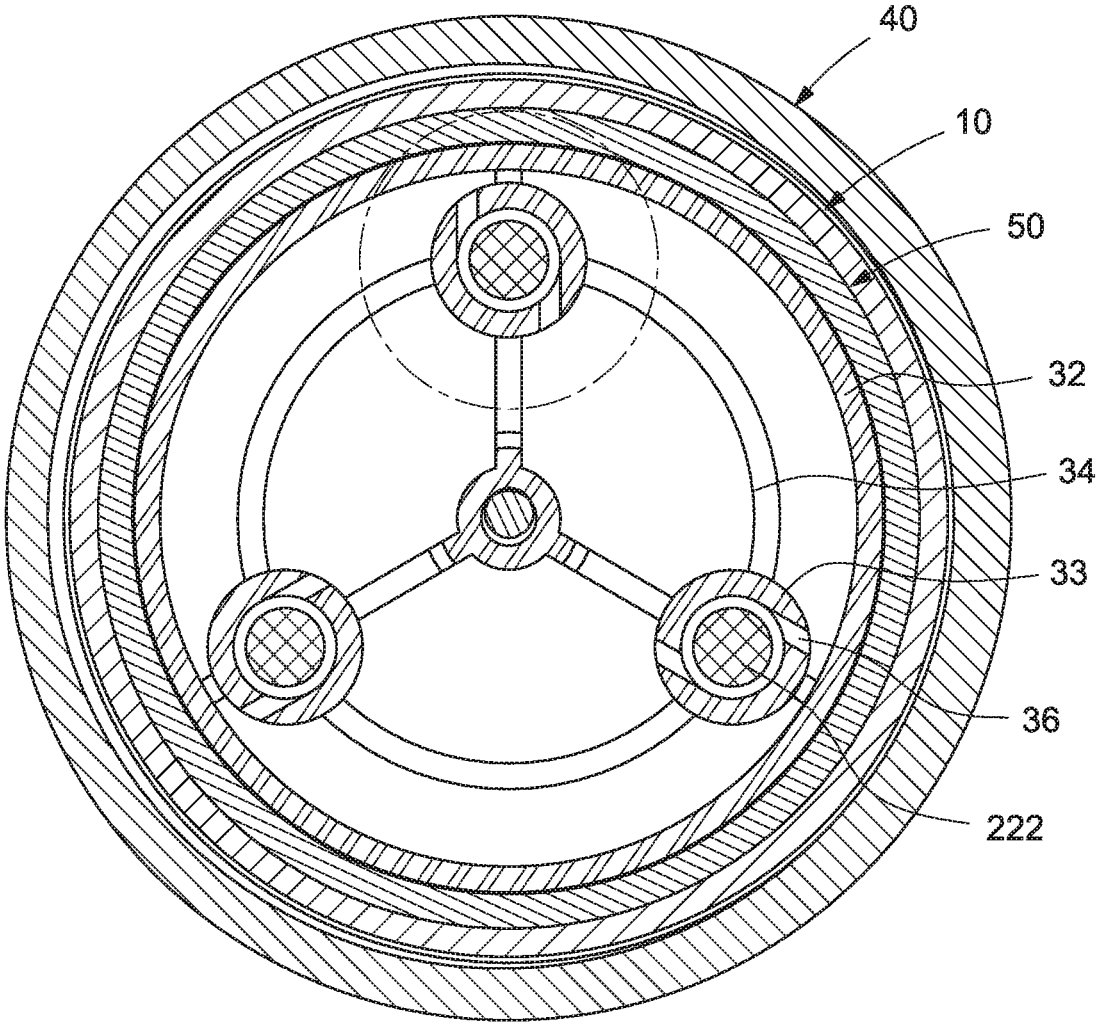
FIG. 8 is a cross-sectional view of the nozzle taken along a line A-A shown in FIG. 7.
Figure 9:
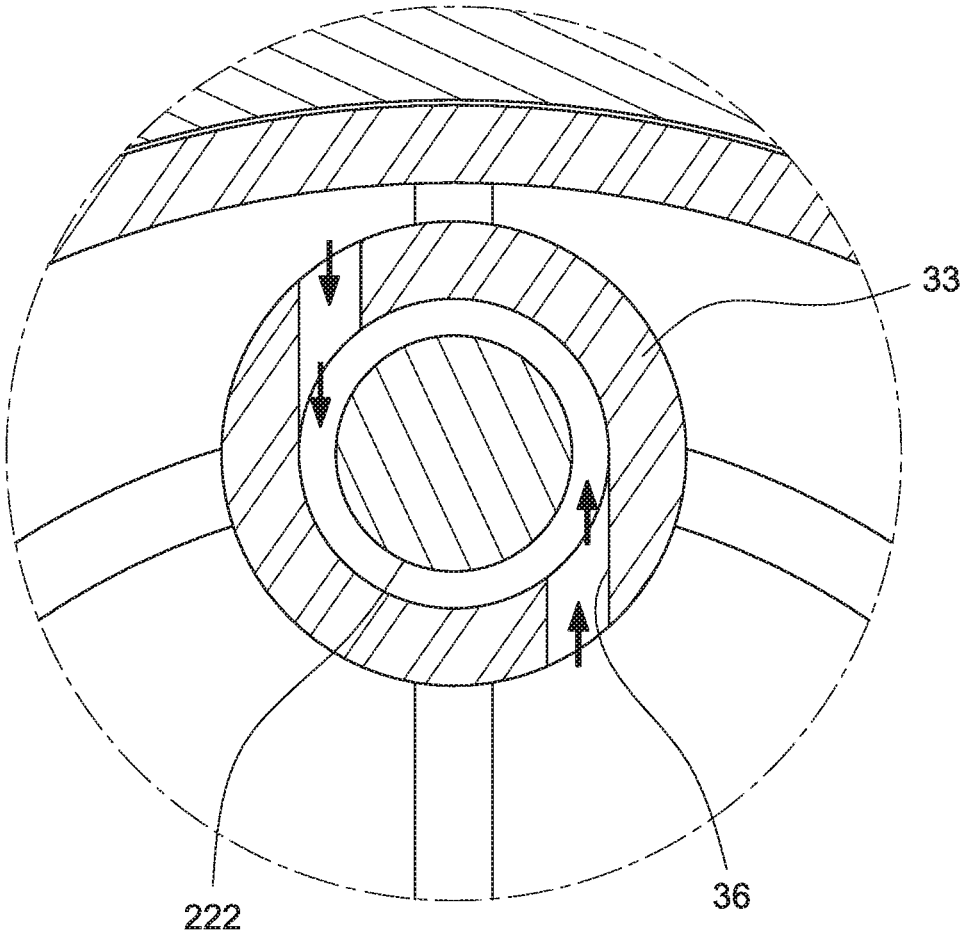
FIG. 9 is an enlarged partial view of the nozzle shown in FIG. 8.
Figure 10:
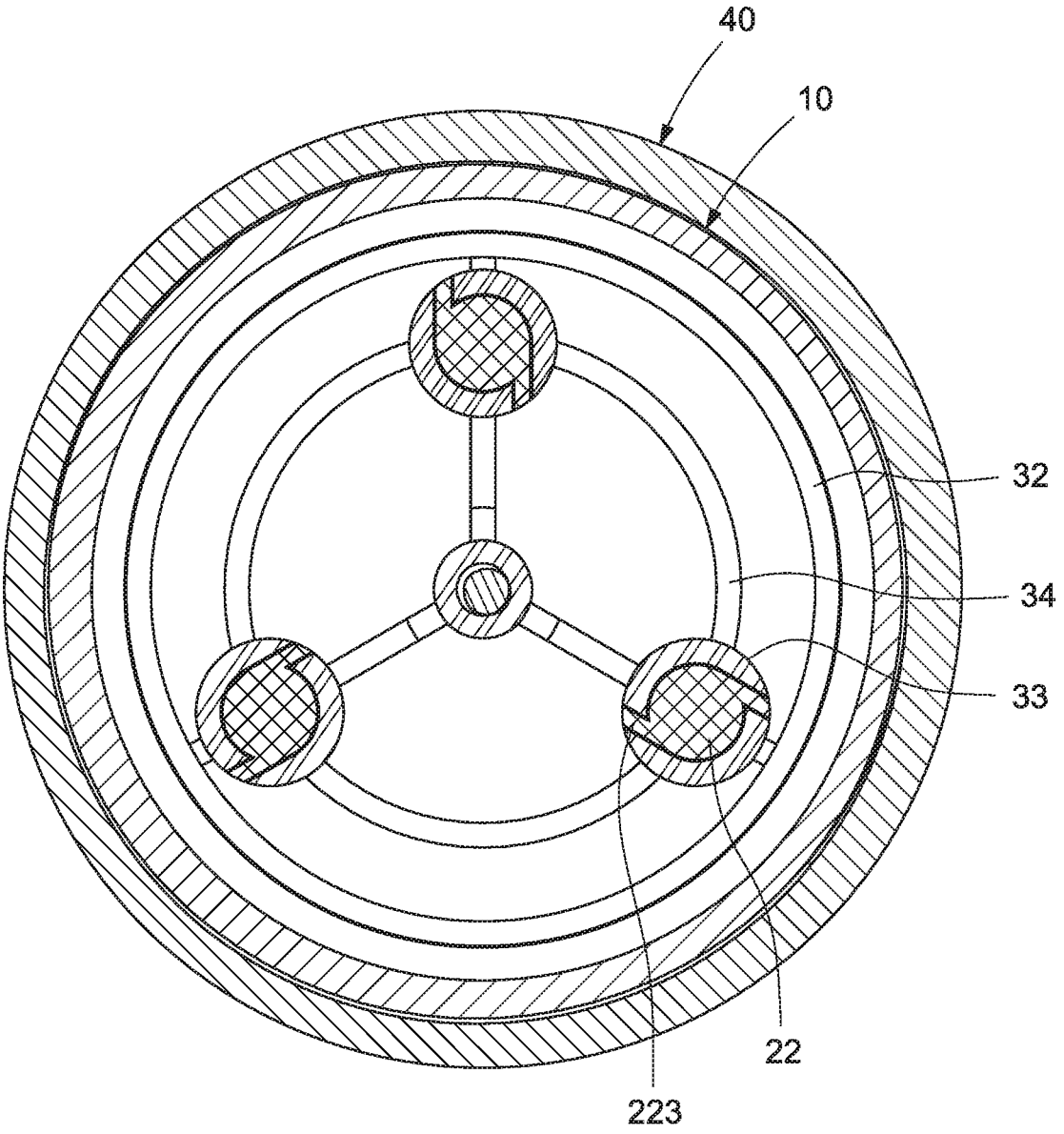
FIG. 10 is a cross-sectional view of to the nozzle taken along a line B-B shown in FIG. 7.

The internal thread 12 of the shell 10 is engaged with a thread (not numbered) formed on an external face of a barrel of a sprayer G (FIG. 6) or a hose W (FIG. 7). In operation, water goes into the chamber 11 of the shell 10. Then, the water goes into the tubes 33 through the tangential passageways 36. A portion of the water enters each of the tubes 33 in two streams that form a whirlpool since each of the tangential passageways 36 extends in a tangential direction of the internal face of each of the tubes 33. The conical section 222 of each of the protuberances 22 keeps the corresponding streams from interfering with each other. The conical section 222 of each of the protuberances 22 guides the corresponding portion of the water from the nozzle via the corresponding outlet 35 of the panel 30. Thus, the water leaves the nozzle at high speed, covers a large area, and is well atomized.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A nozzle for providing a helical spray comprising:

a shell (10) comprising a chamber (11) extending through the shell (10);

a distributor (20) inserted in the chamber (11), wherein the distributor (20) comprises multiple protuberances (22) each of which comprises a cylindrical section (221), a conical section (222) extending from the cylindrical section (221), and two fins (223) extending from the cylindrical section (221);

a panel (30) comprising:

multiple outlets (35) extending through the panel (30); and multiple tubes (33) each of which is in communication with a corresponding one of the outlets (35) and comprises multiple tangential passageways (36), wherein each of the tubes (33) receives a corresponding one of the protuberances (22), wherein the tangential passageways (36) of each of the tubes (33) receive the fins (223) of the corresponding protuberance (22) so that each of the tangential passageways (36) is partially blocked by the corresponding fin (223);

a collar (40) connected to the shell (10), wherein the collar (40) comprises:

an opening (41) for receiving the panel (30); and an annular flange (43) extending from a wall of the opening (41), wherein the panel (30) is sandwiched between the annular flange (43) of the collar (40) and an end of the shell (10).

2. The nozzle according to claim 1, wherein each of the tangential passageways (36) extends in a tangential direction of an internal face of each of the tubes (33).

3. The nozzle according to claim 1, wherein the shell (10) comprises an external thread (13), wherein the collar (40) comprises a thread (42) engaged with the external thread (12).

4. The nozzle according to claim 1, further comprising a sealing ring (50) located between the shell (10) and the panel (30).

5. The nozzle according to claim 4, wherein the panel (30) comprises an external annular portion (32), wherein the sealing ring (50) comprises:

a transverse section (51) located between the panel (30) and an end of the shell (10); and a longitudinal section (52) located between an internal face of the chamber (11) and an external face of the external annular portion (32).

6. The nozzle according to claim 1, wherein the shell (10) comprises an internal thread (12) for engagement with a thread of a hose (W).

7. The nozzle according to claim 1, wherein the shell (10) comprises an internal thread (12) for engagement with a thread of a barrel of a sprayer (G).

8. The nozzle according to claim 1, further comprising a screw (C) inserted in the panel (30) through the distributor (2).

9. The nozzle according to claim 8, wherein the distributor (2) comprises an orifice (21), wherein the panel (30) comprises a screw hole (31), wherein the screw (C) is inserted in the screw hole (31) through the orifice (21).

* * * * *